US007360493B2

(12) United States Patent
Hummel et al.

(10) Patent No.: US 7,360,493 B2
(45) Date of Patent: Apr. 22, 2008

(54) MODULAR PALLET AND METHOD

(75) Inventors: Michael J. Hummel, Portland, MI (US); John P. Conner, Grandville, MI (US); Gregory D. Dobie, Eagle, MI (US); Craig G. Wright, Charlotte, MI (US)

(73) Assignee: 21st Century Plastics Corporation, Potterville, MI (US)

( * ) Notice: Subject to any disclaimer, the term of this patent is extended or adjusted under 35 U.S.C. 154(b) by 261 days.

(21) Appl. No.: 10/710,917

(22) Filed: Aug. 12, 2004

(65) Prior Publication Data

US 2006/0032411 A1 Feb. 16, 2006

(51) Int. Cl.
*B65D 19/12* (2006.01)

(52) U.S. Cl. ..... 108/54.1; 108/53.3

(58) Field of Classification Search ..... 206/386, 206/598, 599, 600; 108/56.1, 51.11, 53.1, 108/55.1, 901, 53.3, 57.1, 57.28, 54.1
See application file for complete search history.

(56) References Cited

U.S. PATENT DOCUMENTS 2,909,349 A * 10/1959 Morris ..... 108/54.1
2,909,350 A * 10/1959 Morris ..... 108/54.1
2,973,931 A * 3/1961 Brown ..... 108/53.3
3,329,103 A * 7/1967 Cohen ..... 108/54.1
3,695,187 A * 10/1972 Weiss ..... 108/54.1
3,977,333 A * 8/1976 Phillips ..... 108/54.1
4,095,769 A * 6/1978 Fengels ..... 248/346.02
5,094,175 A 3/1992 Christie
5,123,541 A * 6/1992 Giannini et al. ..... 206/600
5,365,859 A 11/1994 Schrage
5,415,286 A * 5/1995 Marchek et al. ..... 206/722
5,440,998 A 8/1995 Morgan, IV et al.
5,483,899 A 1/1996 Christie
5,492,069 A 2/1996 Alexander et al.
5,582,113 A 12/1996 Langenbeck
5,603,266 A 2/1997 Nash
5,626,231 A 5/1997 Kwong et al.
5,651,463 A * 7/1997 Major et al. ..... 206/599
5,666,886 A 9/1997 Alexander et al.
5,676,063 A 10/1997 Wallace (Continued)

FOREIGN PATENT DOCUMENTS

GB 2354505 * 3/2001

OTHER PUBLICATIONS

CA 2095369 Dickie et al; abstract and drawing Nov. 1993.*

*Primary Examiner*—Janet M. Wilkens
(74) *Attorney, Agent, or Firm*—Foster, Swift, Collins & Smith, P.C.; Allan O. Maki

(57) ABSTRACT

A pallet is formed of two or more sections formed of plastic materials. The sections are adjustably fixed together using elongated connectors dimensioned to fit closely in channels with each of the connectors extending between a channel of one section and a channel of an adjoining section. The sections and the connectors are adjustably secured together by mechanical fasteners. Spaced apertures are provided through each of the channels and similarly spaced apertures are provided through each of the connectors whereby the dimensions of the pallet are adjustable. Pallets are provided that can be nested in an inverted orientation without increasing the thickness of the inverted pair greater than the thickness of a single pallet.

8 Claims, 9 Drawing Sheets

U.S. PATENT DOCUMENTS 5,676,064 A 10/1997 Shuert
5,676,067 A 10/1997 Breindel
5,706,738 A * 1/1998 Rapeli ..... 108/54.1
5,778,801 A 7/1998 Delacour
5,791,261 A 8/1998 John et al.
5,794,543 A 8/1998 John et al.
5,809,905 A 9/1998 John et al.
5,860,369 A 1/1999 John et al.
5,870,958 A * 2/1999 Suzuki ..... 108/54.1
5,887,529 A 3/1999 John et al.
6,006,677 A 12/1999 Apps et al.
6,024,223 A * 2/2000 Ritter ..... 206/600
6,109,190 A 8/2000 Hale et al.
6,123,208 A * 9/2000 Haenszel ..... 211/175
6,199,487 B1 3/2001 Coddington
6,199,488 B1 3/2001 Favaron et al.
6,220,183 B1 4/2001 Schwitzky
6,244,194 B1 6/2001 Salmanson et al.
6,354,230 B1 3/2002 Maschio
6,418,861 B1 7/2002 Flam
6,446,563 B1 9/2002 Ohanesian
6,609,466 B2 8/2003 Salmanson et al.
6,622,642 B2 9/2003 Ohanesian
6,644,219 B2 11/2003 Apps
6,974,140 B2 * 12/2005 Neuman ..... 280/79.11
2001/0031807 A1 10/2001 Adedeji et al.
2002/0017225 A1 2/2002 Koefelda et al.
2002/0104465 A1 8/2002 Ohanesian
2003/0070594 A1 4/2003 Isle et al.
2003/0075081 A1 4/2003 Apps
2003/0136315 A1 7/2003 Kim
2003/0209171 A1 11/2003 Milles
2004/0000259 A1 1/2004 Taft

* cited by examiner

MODULAR PALLET AND METHOD

FIELD OF THE INVENTION

This invention is related to pallet construction and more particularly to a pallet and method employing modules that are adjustably interconnected.

BACKGROUND OF THE INVENTION

The use of pallets, traditionally constructed from wood and used for storage and transportation of products, is well known. Such pallets facilitate product handling, for example, by a forklift by means of which they are moved for loading onto a cargo vehicle or stored until needed.

The disadvantages of wood, such as absorption of water, splintering, attack by insects, etc. are also well known. This has led to occasional use of pallets formed out of metals such as steel or aluminum or various polymeric plastic materials. Nonetheless, the materials handling industry could benefit from an improved rot and insect resistant pallet system that is adjustable in size and particularly such a system wherein economy of manufacture is achieved by the ability to manufacture pallet sections of standardized sizes that later can be assembled into pallets of varying dimensions.

SUMMARY OF THE INVENTION

Accordingly, it is an important aspect of the invention to provide a pallet system wherein molded polymeric segments of selected standardized dimensions may be assembled into pallets having varying selected final dimensions.

An important aspect of the invention is the use of connector elements to assemble the segments into a finished pallet. A related further aspect of the invention relates to the provision of channels in the pallet sections for receiving the connector elements in a manner such that the outward dimensions of the sections is not altered by the presence of the connector elements.

In accordance with another aspect of the invention, the connector elements and the pallet sections are each provided with apertures used to fasten together the sections and the connector elements. In accordance with a further related aspect of the invention the apertures are uniformly spaced both in the pallet sections and on the connector elements such that a single connector element may be used to assemble the pallet sections into a variety of desired overall dimensions.

The invention provides a pallet formed of a plurality of sections each of which having upper, lower surfaces and one or more side surfaces. Channels for receiving connector elements are provided in each of the pallet sections and extend through one or more side surfaces into the pallet sections. The channels are adapted for alignment with similar channels in another one of the sections. A plurality of elongated connector elements are dimensioned to fit closely in the aligned channels. Each of the connectors extend between at least two sections tightly fitting within the aligned connector receiving channels of each of the sections.

In accordance with a further aspect of the invention, each of the sections and each of the connector elements are provided with uniformly spaced apertures adapted to be selectively aligned with each other and adapted to receive mechanical fasteners for firmly connecting the pallet sections in predetermined spacing to form pallets of selected overall dimensions.

In accordance with yet another aspect of the invention, the individual pallet sections are nestable and can be transported and stored in nested stacks. Similarly, assembled pallets may be nested together with other assembled pallets of similar dimensions.

Yet another aspect of the invention is the arrangement of legs and openings in a complementary pattern such that two pallet sections may be placed in inverted orientation with the legs of each section facing the other section and the two sections will nest together with each leg received in an opening, so that the thickness of the nested pair of pallet sections is no thicker than that of a single one of the sections. Similarly, two assembled pallets may be nested together when inverted, with the legs of each pallet facing the other with the result that the thickness of the nested pair of pallets is no thicker than that of a single pallet.

Briefly, the invention provides a method and pallet that is formed of two or more sections, each section having upper, lower and side surfaces with channels formed through at least one of the side surfaces of each section and extending into the section. Channels are adapted to be aligned with at least one channel of a second one of the sections. The sections are adjustably fixed together using elongated connectors dimensioned to fit closely in the channels with each of the connectors extending between a channel of one section and a channel of an adjoining section. The sections and the connectors are adjustably secured together by means of mechanical fasteners. Spaced apertures are provided through each of the channels and similarly spaced apertures are provided through each of the connectors whereby the dimensions of the pallet are adjustable.

Additional aspects and advantages of the invention will become apparent from the following detailed description, the drawings, and the appended claims.

BRIEF DESCRIPTION OF THE FIGURES

The foregoing features, as well as other features, will become apparent with reference to the description and figures below, in which like numerals represent like elements, and in which.

DETAILED DESCRIPTION

The present invention generally relates to a pallet formed of sections adjustably interconnected so that pallets having varying selected overall dimensions may be provided utilizing adjustably interconnected sections.

Figure 1:
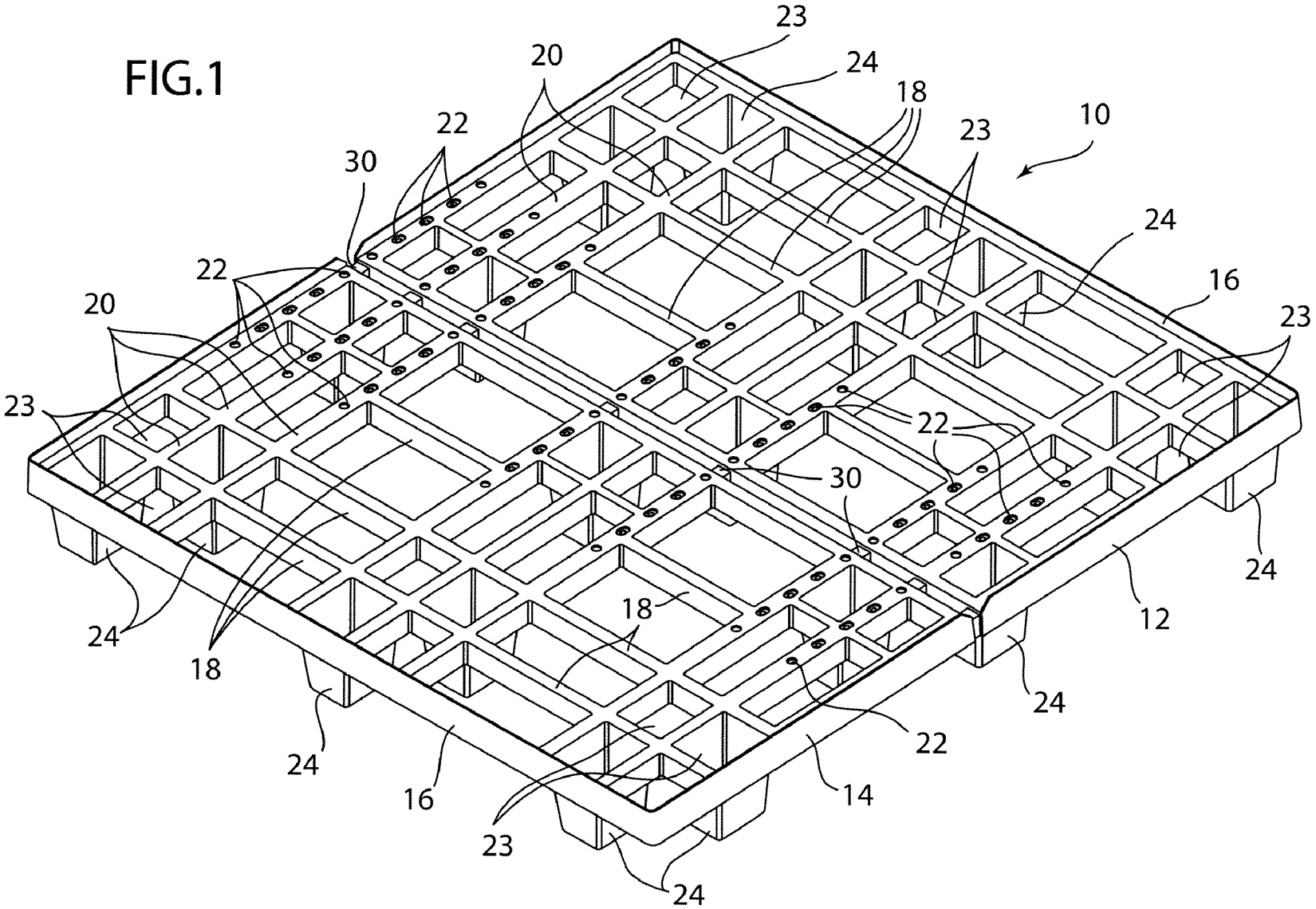
FIG. 1 is a perspective view of an embodiment of a pallet in accordance with the invention.
Figure 2:
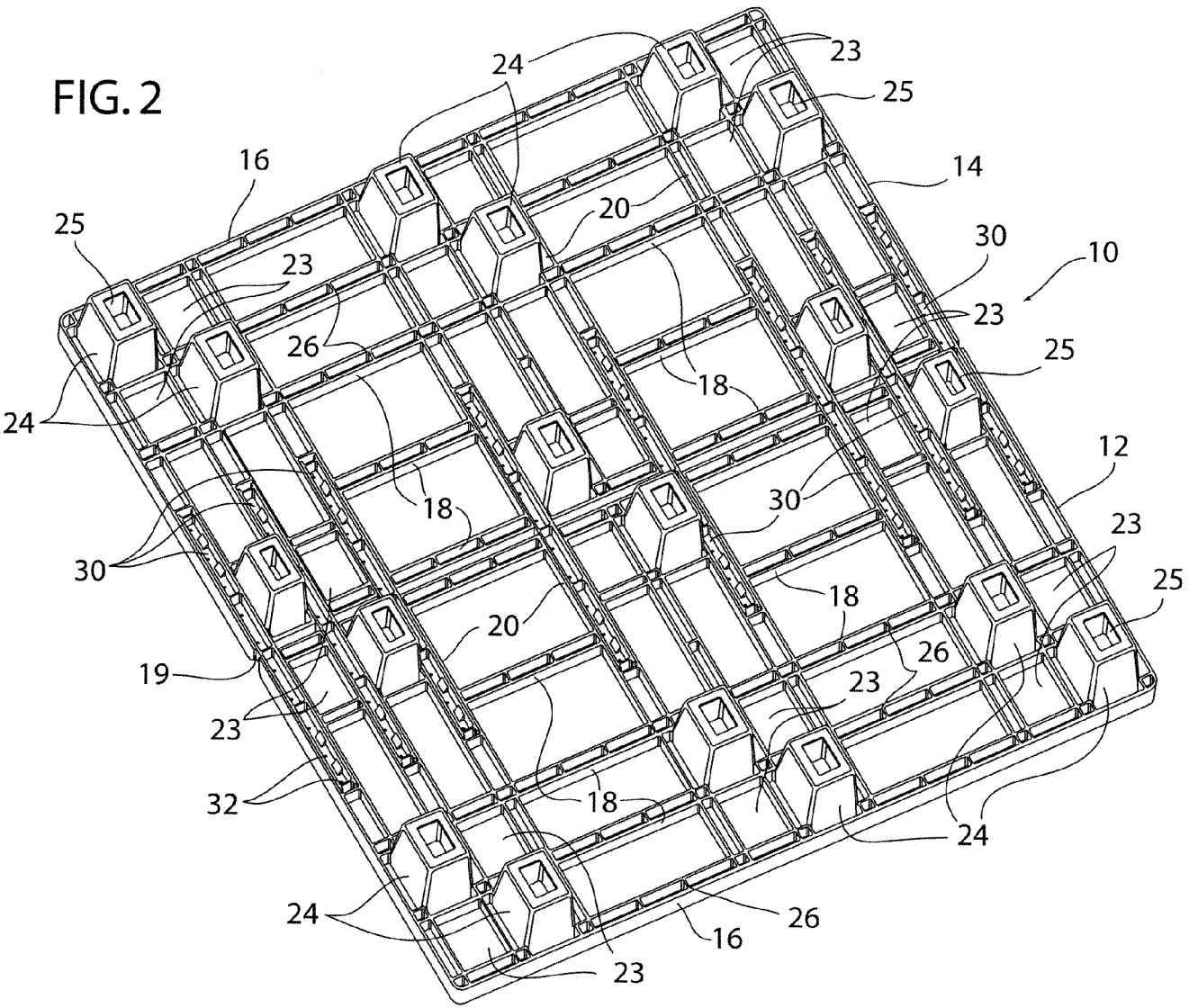
FIG. 2 is a bottom view of the pallet of FIG. 1.
Figure 3:
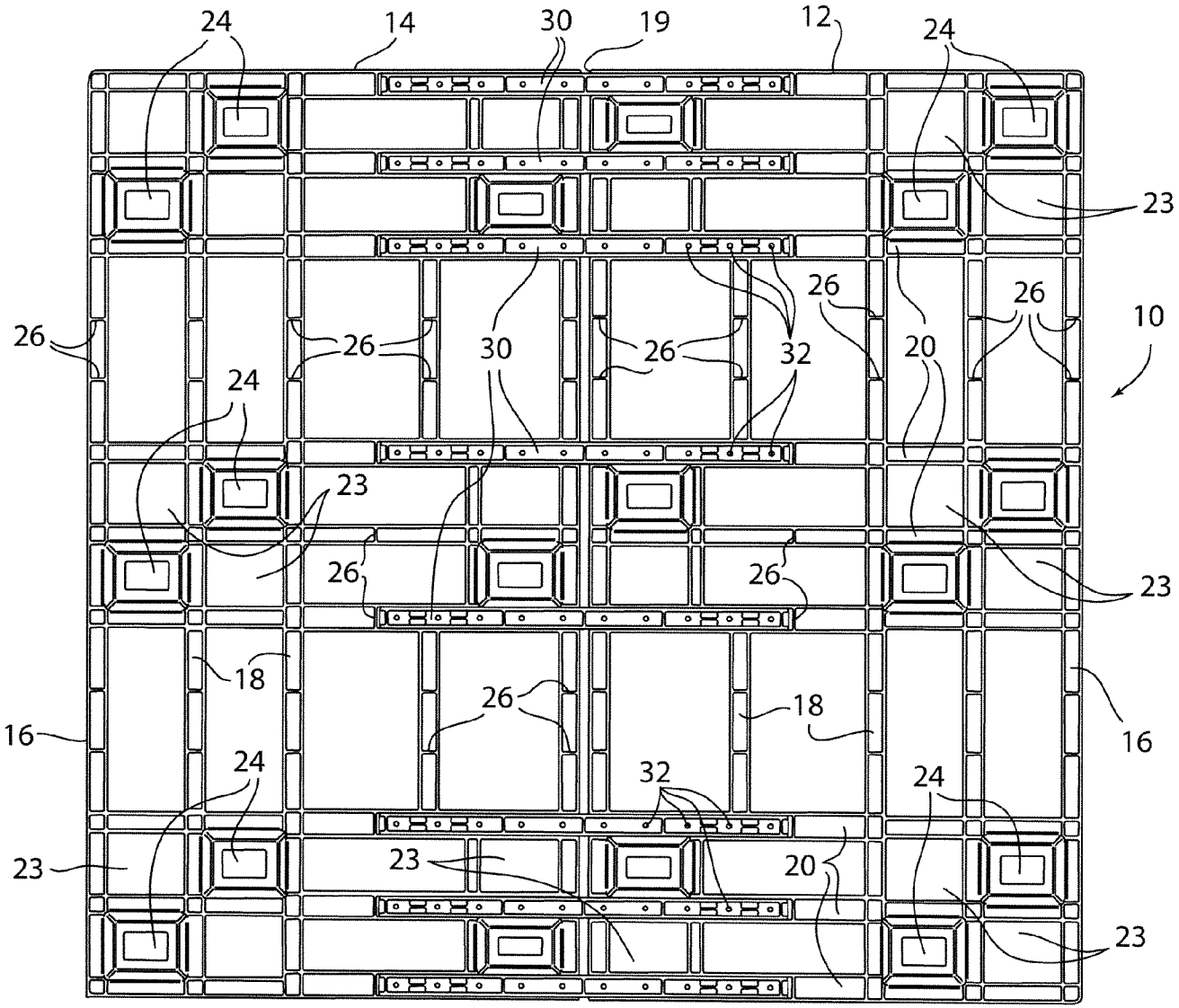
FIG. 3 is a top plan view of the pallet of FIG. 1.

Referring more particularly to the drawings, there is seen in FIGS. 1 through 3 a pallet 10 in accordance with an embodiment of the invention. In the illustrated embodiment, a pair of sections 12 and 14 are shown. Sections 12 and 14 are preferably formed from a molded plastic material, for example, a thermoplastic polymer such as high density polyethylene (HDPE) commonly available as a recycled material. Various other dimensionally stable materials can be used instead.

In the illustrated embodiment it will be noted that each of the sections 12 and 14 are formed of a grid of the molded material including outer perimeter sidewall 16 and an interior grid formed of a plurality of an interior cross members 18 that are of a generally "U" shaped cross section open toward the bottom of the pallet. Sidewall 16 assists in retaining cartons or boxes on the pallet, preventing them from sliding off of the pallet 10. Members 18 intersect and are integral with similar members 20 that extend at 90 degrees crosswise to members 18 to form the interior grid structure of pallet 10. Members 20 are similarly of an inverted "U" shaped configuration open toward the bottom and additionally have openings 19 along one side, which provide access for insertion of connectors 30 into the interior channels within members 20. Members 20 are also provided with a plurality of uniformly spaced apertures 22.

Also integral with the molded cross members 18 and 20 are a plurality of molded supporting legs 24 provided with indentations 25 in their bottom surfaces to provide improved rigidity and dimensional stability. In the illustrated embodiment, supporting legs 24 are shown in a staggered configuration that provides stable support for pallet 10 and also provides open channels between the rows of supporting legs useful for insertion of forklift tines so that pallet 10 may be approached by means of a forklift from any side, thereby enhancing ease of handling. It will also be noted that in the illustrated embodiment, sections 12 and 14 are essentially identical with the result that any two sections may be assembled together to form a finished panel 10 in accordance with the invention. The sections, moreover, may be nested together for ease of storage and handling of a number of sections. Stacking together and subsequent separation of individual sections is facilitated by the tapered design of legs 24.

Figure 8:
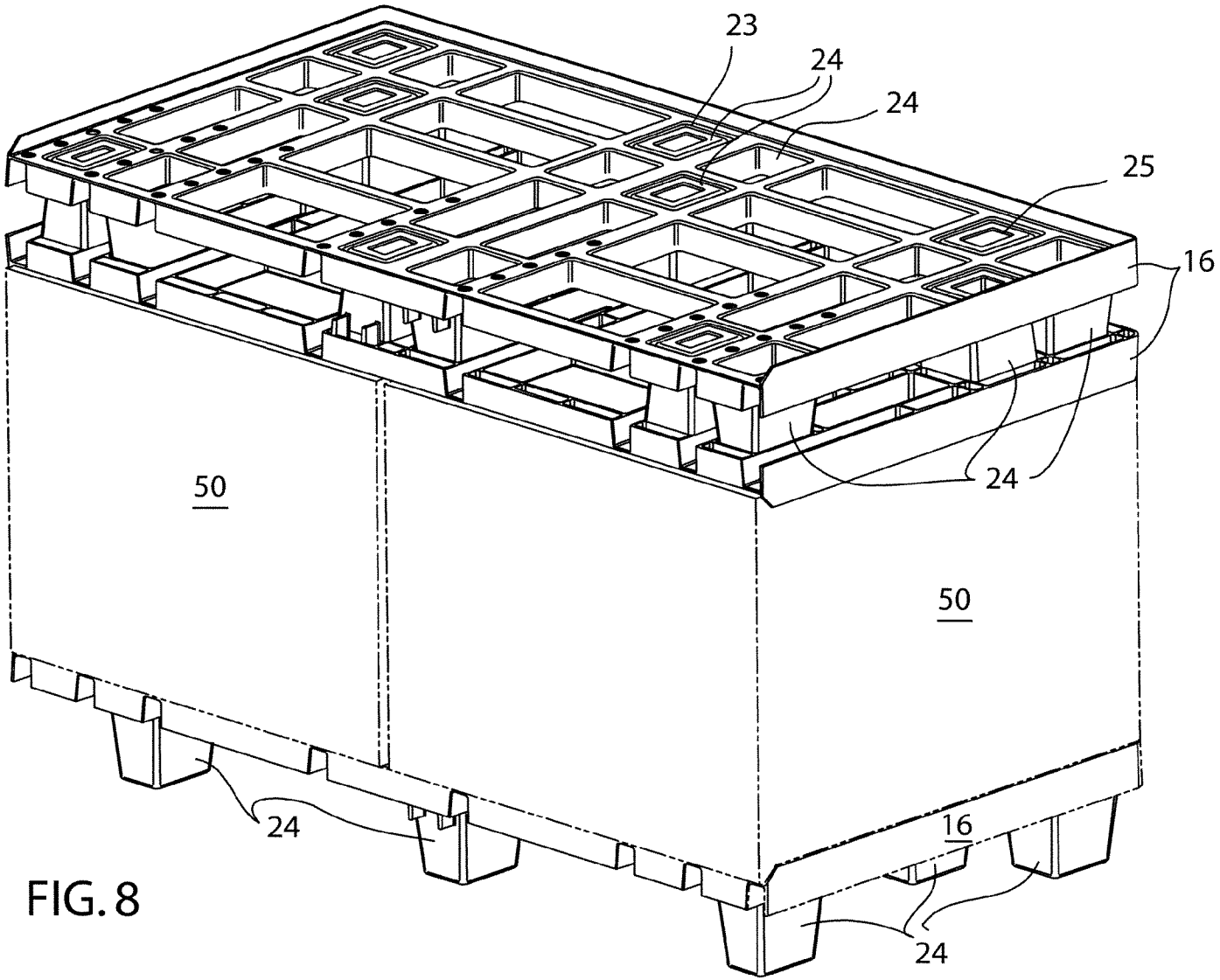
FIG. 8 is a perspective view illustrating stackability of pallets and pallet sections of the invention in an inverted orientation.
Figure 9:
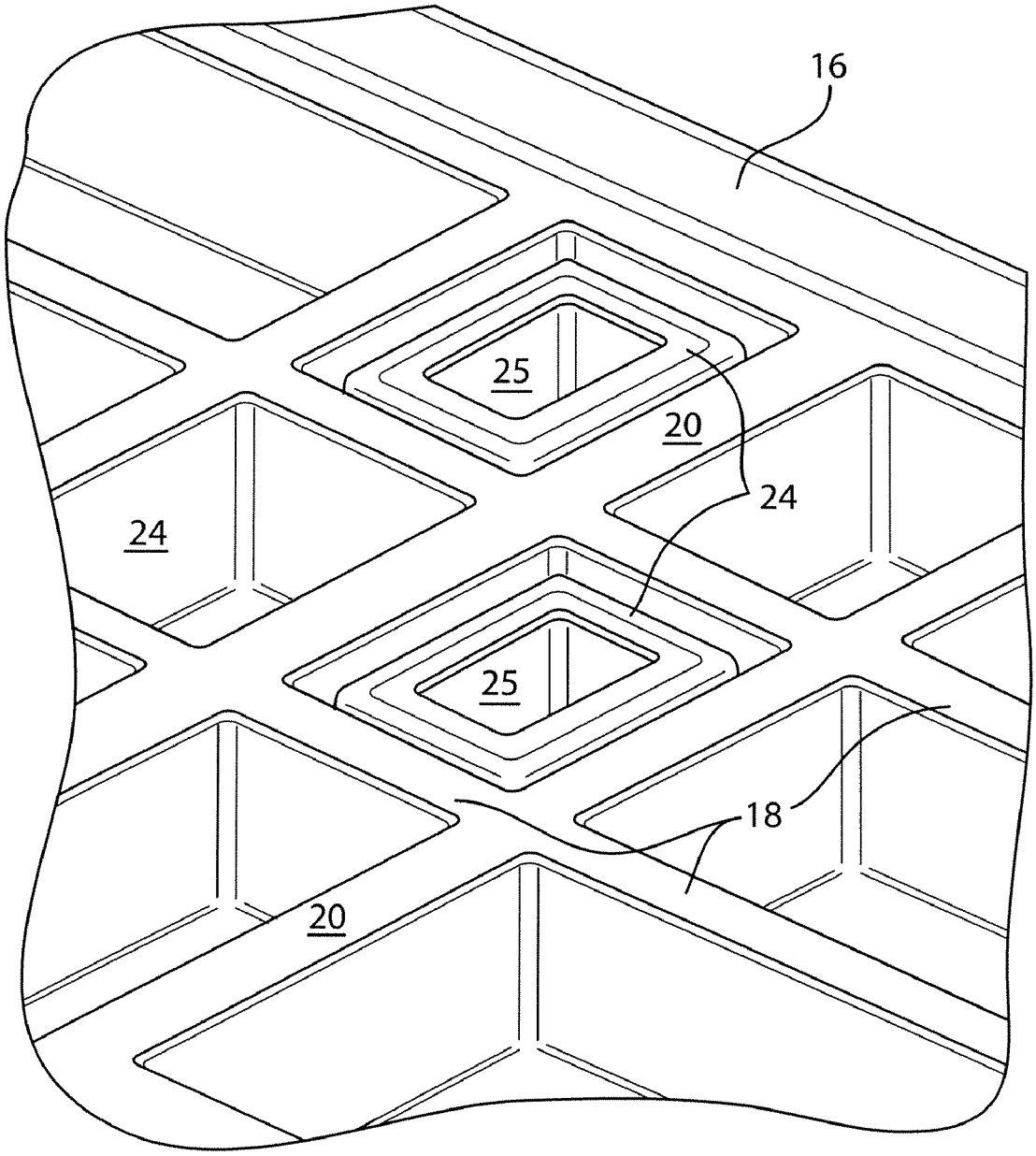
FIG. 9 is an enlarged fragmentary view of a section of the inverted pallet assembly of FIG. 8.

A further novel feature of the invention results from the arrangement of the staggered legs 24 and openings 23 in a complementary staggered pattern such that when one of the pallet sections is inverted and placed over another section as shown in FIGS. 8 and 9, legs 24 of each of the sections will fit within openings 23 of the other section. As seen in FIG. 8, the thickness between the carton-engaging surfaces (and legs nested therein) of the two inverted pallet sections in facing relationship is not any greater than that of a single section. Thus additional rows of cartons 50 can be stacked above a first row. The inverted pallets protect cartons 50 below against being crushed by the weight of cartons stacked above. The edge flanges of outer sidewall 16 of each of the inverted pallet sections also lend stability to the stacked cartons. While single pallet sections are shown in FIG. 8, it is understood that the same advantages are obtained in the case of assembled pallets.

Figure 4:
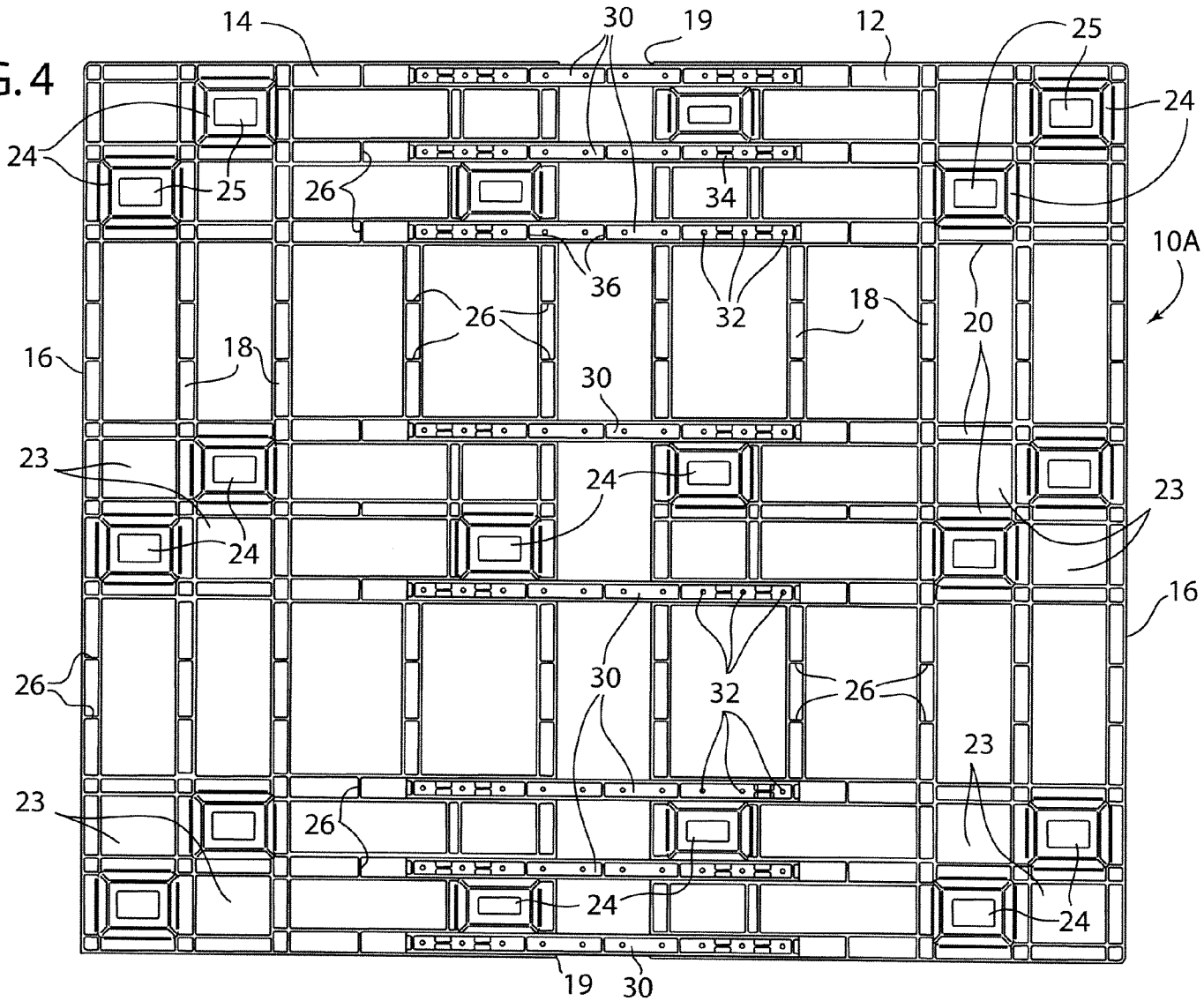
FIG. 4 is a bottom view of the pallet of FIG. 1 assembled to a different selected width.

Also as best seen in FIGS. 3 and 4, each of the inverted "U" shaped members 16, 18 and 20 are provided with spaced ribs 26 that provide anti-twist characteristics and crush resistance to individual members 16, 18 and 20 and thus to the finished assembled pallet 10.

Figure 5:
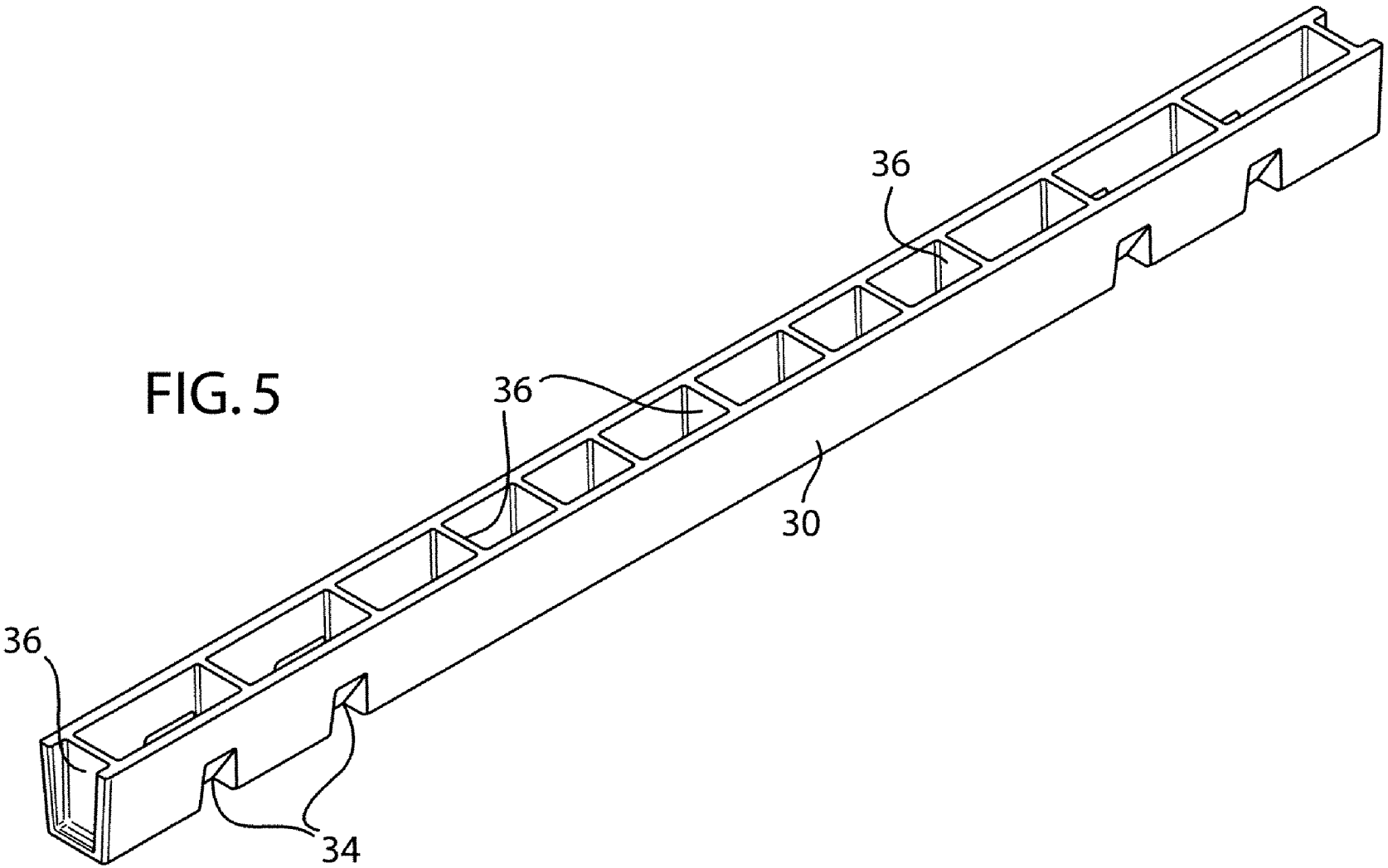
FIG. 5 is a perspective view of an elongated connector used in the practice of the invention viewed toward the bottom.
Figure 6:
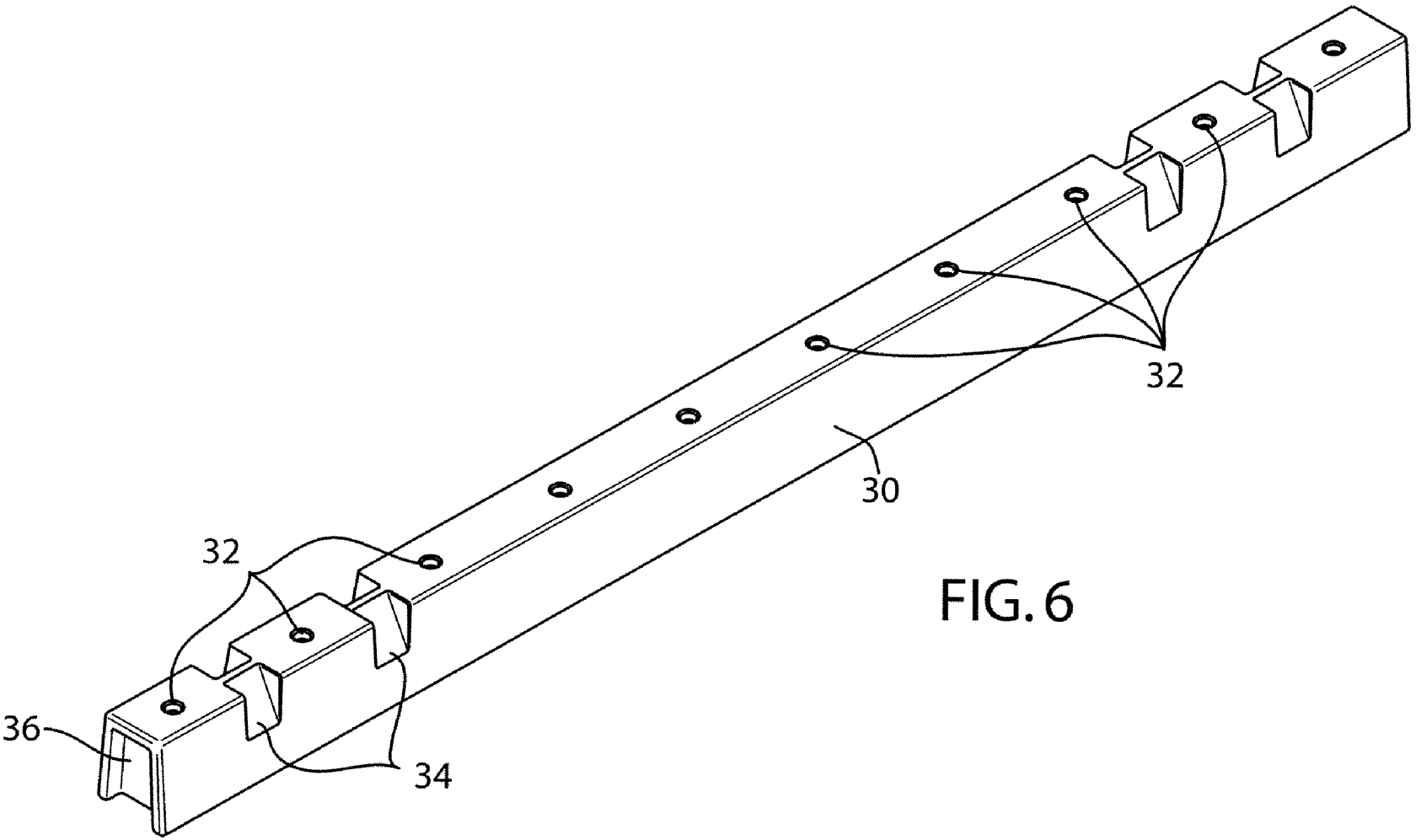
FIG. 6 is a perspective view of the connector of FIG. 5 viewed toward the top.

Referring now to FIG. 3 in conjunction with FIGS. 5 and 6, it is seen that a plurality of elongated connectors 30 are utilized to secure sections 12 and 14 of pallet 10. Each of elongated connectors 30 is provided with a series of apertures 32 adapted to be aligned with apertures 22 of cross members 20. Apertures 32 are uniformly spaced apart the same distance as apertures 22 so that they may be aligned with various ones of the apertures 22 thereby allowing one dimension of pallet 10, generally referred to as the length, to be adjusted by providing a selected distance between the sections 12 and 14.

Referring to FIG. 4, there is seen an assembled pallet 10A formed of sections 12 and 14 similar to those used in the embodiment of FIGS. 1-3. The modified pallet 10A is formed by spacing sections 12 and 14 apart from one another and fastening them together with elongated connectors 30 using selected sets of apertures 22 and 32. Thus, it is seen that pallets having selected desired widths can be provided in accordance with the teachings of the invention.

In assembly of pallet 10, sections 12 and 14, with connecting members 30 in position within the channels formed in cross members 20, are placed so that a plurality of apertures 20 are aligned with apertures 32 of each of connecting elements 30. Mechanical fasteners can then be used to fix sections 12 and 14 at the selected spacing from each other. The specific mechanical fasteners utilized are optional, but may include self-tapping screws, bolts, rivets, or appropriately dimensioned pin-shaped snap fasteners.

Figure 7:
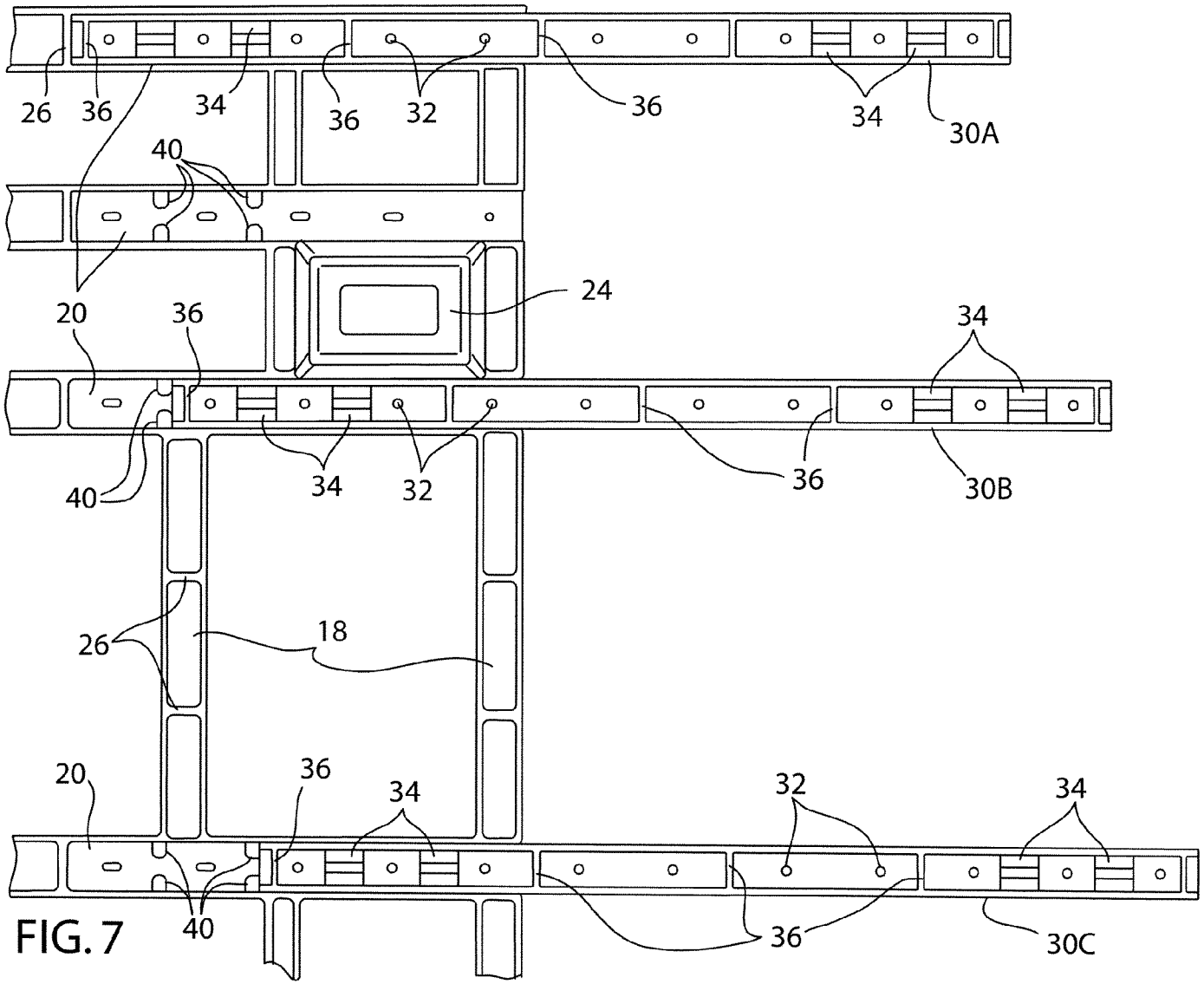
FIG. 7 is a fragmentary top plan view of a pallet showing connectors inserted different distances therein.

As seen in FIGS. 5-7, connectors 30 are provided with indented areas 34 having inclined surfaces that impart enhanced rigidity and crush resistance to the connectors 30. Cross ribs 36 are provided in the otherwise hollow U-shaped channels that form connectors 30. The number of cross ribs 36 utilized is a matter of choice depending on the stresses to which the pallet is expected to be subjected to during use. For example, in FIG. 5, a version is shown with numerous cross ribs 36 to provide optimum resistance of the connector 30 to crushing or twisting. For lighter duty uses, the connectors 30 shown in various other figures utilizing less cross ribs 36 are suitable. Indentations 34 also interact with ribs or protrusions 40 formed in the interior walls of cross members 20. Ribs or protrusions 40 project only a limited distance from the upper interior surfaces of members 20. Thus, when indentations 34 are positioned immediately under protrusions 40 they provide interior support against crushing to the connectors 30.

Referring to FIG. 7, the interaction between the internal ribs 26 and 40 of members 20 at differing depths of insertion of connectors 30A, 30B and 30C is illustrated. Connector 30A is shown inserted to the maximum depth of insertion into the channel of member 20. In this case cross rib 26 acts as a stop against the end of connector 30A and indentations 34 are aligned with protrusions 40, thereby supporting members 20 on the indentations 34.

In the case of connector 30B, an orientation useful in forming a somewhat longer pallet is shown. In this case the end of connector 30B is abutted against one set of ribs 40, which serves as a stop while another set of ribs 40 is supported on one of the indentations 34. Finally, in the case of connector 30C, an orientation is shown wherein a pallet of maximum length is formed. In this case, the outermost set of protrusions 40 is used as a stop.

It will be noted that each of sections 12 and 14 could be formed of several pieces that are assembled together using appropriate adhesives or fasteners. However, it is greatly preferred that each section be formed of one integral molded piece thus forming a stable lattice or grid-like structure including the intersecting members 18 and 20 with openings therebetween and with some portions of the structure being integral with supporting legs 24.

While the invention has been described in conjunction with specific embodiments, it is evident that many alternatives, modifications and variations will be apparent to those skilled in the art in light of the foregoing description. Accordingly, the present invention attempts to embrace all such alternatives, modifications and variations that fall within the spirit and scope of the appended claims.

The invention claimed is:

1. A pallet, comprising:

a plurality of sections, each section being formed of a single molded polymeric piece having upper, lower and side surfaces;

channels formed through at least one of the side surfaces of each section and extending into the section;

said channels of a first one of said sections being adapted to be aligned with a said at least one channel of a second one of said sections;

a plurality of integral supporting legs extending downwardly from the lower surfaces;

the upper surfaces being formed by a lattice structure of integrally molded intersecting members having an inverted U-shaped cross-section, said channels being formed in said intersecting members; and a plurality of elongated connectors dimensioned to fit closely in said channels of said first one of said sections, each of the connectors extending between a selected one of said channels of said first one of said sections and a selected one of said channels of said second section.

2. A pallet according to claim 1, wherein said channels and said connectors are all substantially rectangular in cross section.

3. A pallet according to claim 2, wherein said channels are provided with internal ribs, at least one of said ribs being positioned to limit the distance of insertion of a respective said connector into said respective channel.

4. A pallet according to claim 2, wherein each of said connectors is provided with at least one area having an indented cross section and each said channel adapted to receive said connector is provided with a rib extending a limited distance from an upper internal surface of said channel, said rib being adapted to engage said area of indented cross section.

5. A pallet according to claim 1, wherein said first and second sections are substantially identical to each other.

6. A pallet according to claim 1, wherein said sections and said connectors are secured together by means of mechanical fasteners.

7. A pallet according to claim 1, wherein a plurality of spaced apertures are provided through each of said channels and substantially similarly spaced apertures are provided through each of said connectors whereby the dimensions of the said pallet are adjustable.

8. A plurality of identically dimensioned pallets, each comprising:

a body formed of a grid having upper, lower and side surfaces;

a plurality of legs extending from said lower surfaces arranged in a staggered pattern, a plurality of openings through said grid arranged in a staggered pattern complementary to the pattern of said legs and sized to receive said legs, such that selected first and second ones of said pallets can be placed in inverted orientation with the legs of each pallet facing the other pallet and the two pallets will nest together with each leg of each of said pallets being received in an opening through the other one of said pallets, whereby the thickness between the upper surface of said first pallet and the inverted upper surface of said second pallet is no greater than the distance between the upper surface and ends of said legs of a selected one of said pallets.

* * * * *